US007475843B2

(12) United States Patent
Ueki et al.

(10) Patent No.: US 7,475,843 B2
(45) Date of Patent: Jan. 13, 2009

(54) WINDING JIG, POLYGONAL COIL, AND METHOD OF MANUFACTURING POLYGONAL COIL

(75) Inventors: Takashi Ueki, Nishiokitama-gun (JP); Teruo Tamada, Yonezawa (JP); Teiji Wagatsuma, Yonezawa (JP); Takashi Fujimi, Yonezawa (JP); Koichi Igarashi, Yonezawa (JP)

(73) Assignee: Yonezawa Electric Wire Co., Ltd., Yamagata-ken (JP)

( * ) Notice: Subject to any disclaimer, the term of this patent is extended or adjusted under 35 U.S.C. 154(b) by 0 days.

(21) Appl. No.: 12/075,132

(22) Filed: Mar. 7, 2008

(65) Prior Publication Data

US 2008/0223974 A1 Sep. 18, 2008

(30) Foreign Application Priority Data

Mar. 13, 2007 (JP) ..... P2007-063619
Feb. 25, 2008 (JP) ..... P2008-043473

(51) Int. Cl.
*B21F 3/04* (2006.01)

(52) U.S. Cl. ..... 242/437.4; 242/432.6; 242/433.4; 242/437

(58) Field of Classification Search ..... 254/432.6, 254/433.4, 437, 437.4
See application file for complete search history.

(56) References Cited

U.S. PATENT DOCUMENTS 4,859,890 A * 8/1989 Sedgewick ..... 310/208
5,340,043 A * 8/1994 Beakes et al. ..... 242/432.6
5,687,927 A * 11/1997 Beakes et al. ..... 242/432.6
6,196,273 B1 * 3/2001 Barrera ..... 140/92.2
6,357,689 B1 * 3/2002 Dolgas et al. ..... 242/432.6

FOREIGN PATENT DOCUMENTS

JP 2005-136342 5/2005
JP 2005-137173 5/2005

* cited by examiner

*Primary Examiner*—Emmanuel M Marcelo
(74) *Attorney, Agent, or Firm*—Hoffmann & Baron, LLP

(57) ABSTRACT

A polygonal coil having a substantially square shape is manufactured by winding a conductive wire in the diameter direction of the core on the core in an overlapping manner by the use of a winding jig in which a first collar portion and a second collar portion are disposed at both ends of a core so as to be opposed to each other and four rod-shaped protrusions are disposed on a surface of the first collar portion opposed to the second collar portion so as to protrude in a radial shape centered on an end of the core,. As a result, it is possible to obtain a polygonal coil with high precision.

10 Claims, 6 Drawing Sheets

WINDING JIG, POLYGONAL COIL, AND METHOD OF MANUFACTURING POLYGONAL COIL

BACKGROUND OF THE INVENTION

1. Field of the Invention

The present invention relates to a winding jig, a method of manufacturing a polygonal coil using the winding jig, and a polygonal coil.

Priority is claimed on Japanese Patent Application No. 2007-63619 filed on Mar. 13, 2007, and on Japanese Patent Application No. 2008-43473 filed on Feb. 25, 2008, the contents of which are incorporated herein by reference.

2. Description of Related Art

Devices (cordless devices) having no cord and having a battery built therein, such as a mobile phone, an electric shaver, a desk cleaner, and a remote controller, have become wide spread. When a device having a secondary coil built therein is set to a charger having a primary coil built therein, electric power can be supplied from the charger to the device by means of electromagnetic induction between the primary coil and the secondary coil without providing a contact point where the charger and the device are connected to each other (see Japanese Patent Application, Publication No. 2005-136342 and Japanese Patent Application, Publication No. 2005-137173).

The secondary coil built in such a non-contact charging device needs to be thin. Accordingly, a coil (hereinafter, also abbreviated as a "one-line multi-layer winding coil"), which is obtained by winding in a diameter direction on a core in a one-line overlapping manner a conductive wire including a plurality of thin metal wires tied in a bundle, is used.

In the non-contact charger, a magnetic shielding sheet is usually attached to the secondary coil so as to protect electric circuit components from electromagnetic waves resulting from electromagnetic induction. When the secondary coil has a ring shape, no coil is disposed at four corners of the magnetic shielding sheet and thus eddy current occurs in the portions as shown in FIG. 12, thereby causing an increase in temperature. Accordingly, a polygonal coil as shown in FIG. 10 is necessary as the secondary coil.

However, it was conventionally difficult to make coils such as a one-line multi-layer winding coil, which is wound in the diameter direction on a core in an overlapping manner, have a polygonal shape with high precision.

For example, as shown in FIG. 11A, even when a conductive wire 6 is wound on a core 92 having a quadrangular prism shape in an overlapping manner by the use of a winding jig 9 in which the core 92 protrudes from the substantial center of a collar portion 91, the obtained one-line multi-layer winding coil 90 is not a shape to be called a polygonal coil but a shape close to a ring shape. Specifically, such a tendency is remarkable when the diameter of the core 92 is smaller than the outer diameter of the coil.

Therefore, in the past, as shown in FIG. 11B, a rectangular coil was shaped by pressing the outer peripheral portion of a ring-shaped coil from four sides indicated by arrows regardless of the shape of the core. By changing the pressing directions, other desired polygonal coils were obtained.

However, the coils obtained by such a press shaping method do not form precise polygons and do not satisfy characteristics of a secondary coil sufficiently.

As a result, there is no method of manufacturing a coil having a polygonal shape with high precision. Here, "a polygonal shape with high precision" means that the ratio of the curved portion to the outer peripheral edge portion of the polygonal coil is small.

The present invention is contrived to solve the above-mentioned problem. An advantage of the present invention is to provide a winding jig for manufacturing a polygonal coil with high precision, a method of manufacturing a polygonal coil using the winding jig, and a polygonal coil manufactured using the winding jig.

SUMMARY OF THE INVENTION

In order to accomplish the above-mentioned object, according to a first aspect of the present invention, there is provided a winding jig comprising a core on which a conductive wire or a single metal wire is wound and collar portions disposed at both ends of the core so as to be opposed to each other. Here, a plurality of rod-shaped protrusions are disposed on at least one of the opposed surfaces of the collar portions so as to protrude in a radial shape centered on an end of the core.

In the winding jig, the plurality of protrusions may be disposed on only one of the opposed surfaces of the collar portions.

In the winding jig, the plurality of protrusions may be disposed on both of the opposed surfaces of the collar portions.

In the winding jig, it is preferable that the number of protrusions is four.

According to a second aspect of the present invention, there is provided a method of manufacturing a polygonal coil by winding one or a plurality of single metal wire(s) or a conductive wire in a diameter direction of the core on the core in an overlapping manner by the use of the above-mentioned winding jig.

According to a third aspect of the present invention, there is provided a polygonal coil obtained by winding one or a plurality of single metal wire(s) or a conductive wire in a diameter direction of the core on the core in an overlapping manner by the use of the above-mentioned winding jig.

It is preferable that the polygonal coil is a rectangular coil in which a conductive wire having one or a plurality of single metal wire(s) or a plurality of thin metal wires tied in a bundle is wound in the diameter direction of the core in a one-line overlapping manner.

According to the above-mentioned configurations, it is possible to obtain a polygonal coil with high precision. It is also possible to provide a cordless device having an excellent charging characteristic by the use of the coil.

DETAILED DESCRIPTION OF THE INVENTION

First Embodiment

Figure 1A:
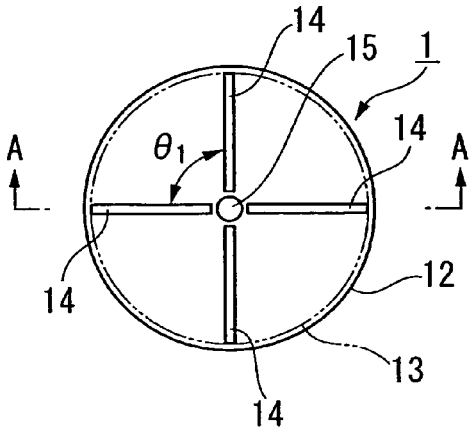
FIG. 1A is a plan view of a first collar portion shown from a protrusion side illustrating a winding jig according to a first embodiment of the present invention.
Figure 1B:
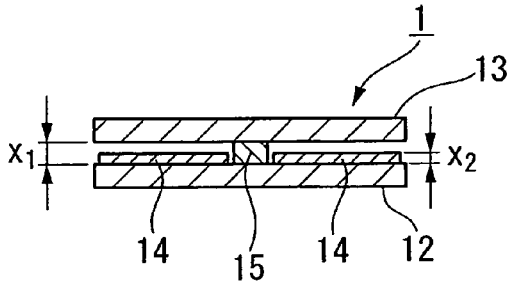
FIG. 1B is a cross-sectional view taken along line A-A of FIG. 1A.

FIGS. 1A and 1B are diagrams illustrating a winding jig according to a first embodiment of the present invention, where FIG. 1A is a plan view and FIG. 1B is a cross-sectional view taken along line A-A of FIG. 1A.

A winding jig 1 includes a cylindrical core 15 and a first collar portion 12 and a second collar portion 13 which have a disc shape and which are disposed at both ends of the core 15 so as to be opposed to each other. The core 15, the first collar portion 12, and the second collar portion 13 are concentric.

Four protrusions 14, 14, . . . having an angular rod shape are disposed on the surface of the first collar portion 12 opposed to the second collar portion 13 so as to protrude in a radial shape centered on an end of the core 15. An angle $\theta_1$ formed by the neighboring protrusions 14 and 14 is constant (right angle).

The size of the winding jig 1 can be properly selected depending on the size of a desired polygonal coil. Specifically, the lengths in the longitudinal direction of the protrusions 14, 14, . . . can be properly adjusted depending on the diameter of a polygonal coil to be manufactured. The lengths in the longitudinal direction of the protrusions 14, 14, . . . may not be the same necessarily.

It is preferable that a distance $X_1$ between the opposed surfaces of the first collar portion 12 and the second collar portion 13 and a height $X_2$ of the protrusions 14, 14, . . . can be properly adjusted depending on the kind of conductive wire to be wound, the diameter thereof, and the kind of desired polygonal coil. In this embodiment, the polygonal precision of the polygonal coil depends on a distance ($X_1$-$X_2$) between the protrusions 14, 14, . . . and the opposed surface of the second collar portion 13.

For example, when a so-called one-line multi-layer winding coil is manufactured which is obtained by winding a conductive wire in the diameter direction of the core 15 in an overlapping manner in which the conductive wire includes a plurality of thin metal wires tied in a bundle, it is preferable that the distance $X_1$ is in the range of 1.5 to 1.9 times the diameter of the conductive wire. On the other hand, it is preferable that the distance ($X_1$-$X_2$) is in the range of 1.0 to 1.5 times the diameter of the conductive wire.

The material of the winding jig 1 is not particularly limited, but may be properly selected depending on the purpose thereof. Examples thereof include, metal, plastic, and combinations of a plurality of materials. The winding jig 1 can be shaped or assembled by the use of well-known methods.

Figure 2A:
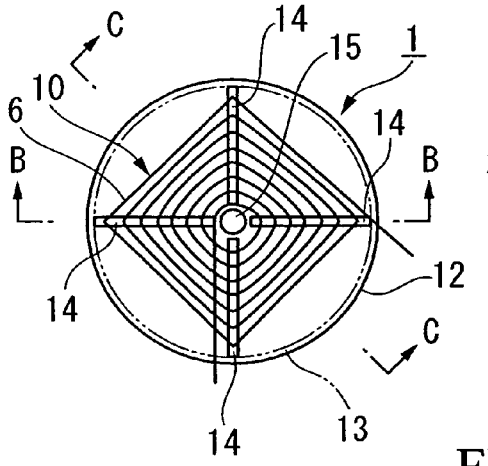
FIG. 2A is a plan view illustrating a process of manufacturing a polygonal coil according to the first embodiment, where a conductive wire is wound on the winding jig.
Figure 2B:
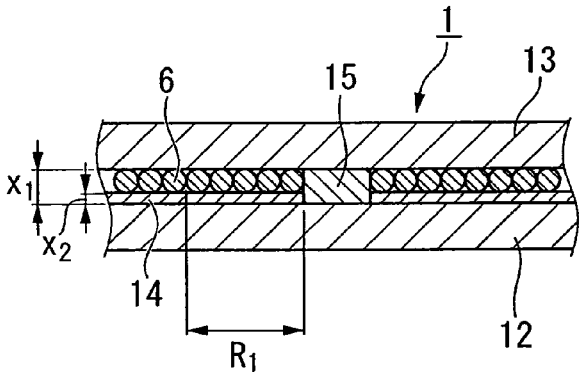
FIG. 2B is an enlarged cross-sectional view taken along line B-B of FIG. 2A.
Figure 2C:
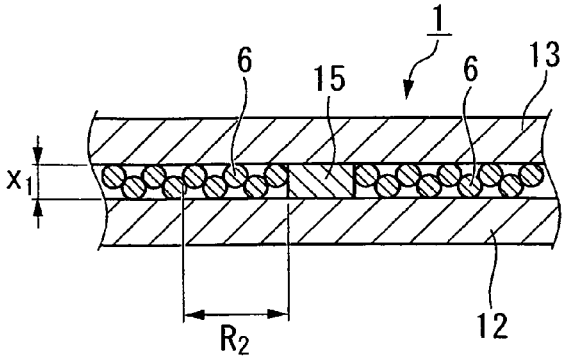
FIG. 2C is an enlarged cross-sectional view taken along line C-C of FIG. 2A.

FIGS. 2A to 2C are diagrams illustrating a process of manufacturing a one-line multi-layer winding polygonal coil 10 using the winding jig 1, where FIG. 2A is a plan view illustrating a state where the conductive wire 6 is wound on the winding jig 1, FIG. 2B is an enlarged cross-sectional view taken along line B-B of FIG. 2A, and FIG. 2C is an enlarged cross-sectional view taken along line C-C of FIG. 2A. In FIG. 2, the same elements as the elements shown in FIG. 1 are denoted by the same reference numerals and thus detailed description thereof is omitted. This is also true for the subsequent drawings.

The conductive wire 6 includes a plurality of thin metal wires tied in a bundle. The diameter of the conductive wire 6 is not particularly limited, but may be properly selected in consideration of the thickness of a desired polygonal coil.

As shown in FIG. 2A, the one-line multi-layer winding polygonal coil is formed by winding the conductive wire 6 in the diameter direction of the core 15 in an overlapping manner in a region interposed between the first collar portion 12 and the second collar portion 13, using a point on the outer peripheral edge of the core 15 as a start point.

At this time, in areas where the protrusions 14 protrude, as shown in FIG. 2B, when the distance ($X_1$-$X_2$) between the protrusions 14 and the second collar portion 13 is substantially equal to the diameter of the conductive wire 6, the conductive wire 6 is interposed between the second collar portion 13 and the protrusions 14 and is wound in a line as shown in FIG. 2B.

On the contrary, in areas apart from the protrusions 14, as shown in FIG. 2C, since the distance $X_1$ between the first collar portion 12 and the second collar portion 13 is larger than the diameter of the conductive wire 6, the winding shape shown in FIG. 2C is obtained.

As a result, in consideration of the diameter of the coil when the conductive wire 6 is wound the same number of times, the diameter $R_1$ overlapping with the protrusions 14 is greater than the diameter $R_2$ at the positions apart from the protrusions 14. As the number of times of winding the conductive wire 6 increases, the difference between $R_1$ and $R_2$ increases and the coil finally becomes a polygonal coil 10 with a substantially regular square shape having vertexes at four positions overlapping with the protrusions 14, 14, . . . on the outer peripheral edge thereof. The resultant polygonal coil 10 has a thickness smaller in the areas overlapping with the protrusions 14 than in the other areas.

The number of times of winding the conductive wire 6 is not particularly limited, but a polygonal coil with higher precision is obtained as the number of times increases.

Although it is shown in FIGS. 1A and 2A that the core 15 has a cylindrical shape, the shape of the core is not limited thereto, but may be a prism shape. For example, a sectional shape in the diameter direction of the core, that is, the shape of the core of the coil, may be any of circular, elliptical, polygonal, etc. shapes. The outer shape of the polygonal coil to be manufactured is hardly affected by the shape of the core.

Although it is shown in FIGS. 1A and 2A that the protrusions 14 have an angular rod shape, the shape of the protrusions is not limited to the angular rod shape, but may have any shape so long as it is convex.

It is preferable that the second collar portion 13 is detachably fixed to an end of the core 15. In this case, the manufactured polygonal coil can be easily separated from the jig. The method of detachably fixing the second collar portion 13 to the end of the core 15 is not particularly limited, but for example, well-known methods of inserting the end of the core 15 into the protrusion disposed at the corresponding position of the second collar portion 13 and the like may be used.

Although it is shown in FIGS. 1A and 2A that the first collar portion and the second collar portion have a disc shape, the collar portions may have any shape so long as it has a plane from which the protrusions can be disposed to protrude.

In this way, by using the winding jig according to the first embodiment of the present invention, polygonal coils having various shapes can be manufactured by changing the number of protrusions arranged in a radial shape in the collar portion and the arrangement pattern. Specifically, the number of vertexes of the polygonal coil is equal to the number of protrusions arranged in a radial shape and the distance between the vertexes is determined based on an angle formed by the neighboring protrusions. Accordingly, the number of protrusions disposed in the collar portion and the angle formed by the neighboring protrusions can be properly selected depending on the purpose thereof.

Second Embodiment

Figure 3:
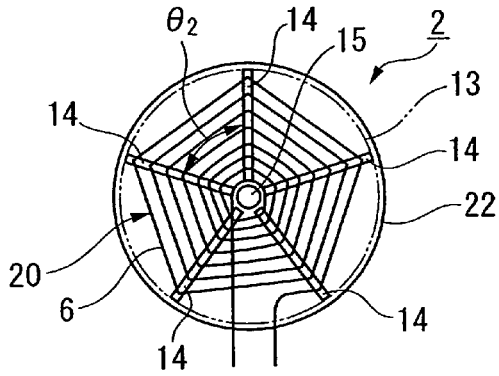
FIG. 3 is a plan view illustrating a winding jig and a polygonal coil according to a second embodiment of the present invention.

FIG. 3 is a plan view illustrating a winding jig and a polygonal coil according to a second embodiment of the present invention.

In a winding jig 2 according to this embodiment, five protrusions 14, 14, . . . are disposed on the surface of a first collar portion 22 opposed to the second collar portion 13 so as to protrude in a radial shape centered on an end of the core 15. An angle $\theta_2$ formed by the neighboring protrusions 14, 14, . . . is constant. The second embodiment is similar to the first embodiment, except for the number of protrusions and the arrangement pattern.

A polygonal coil 20 manufactured using the winding jig 2 as described above has a substantially regular pentagonal shape.

Third Embodiment

Figure 4:
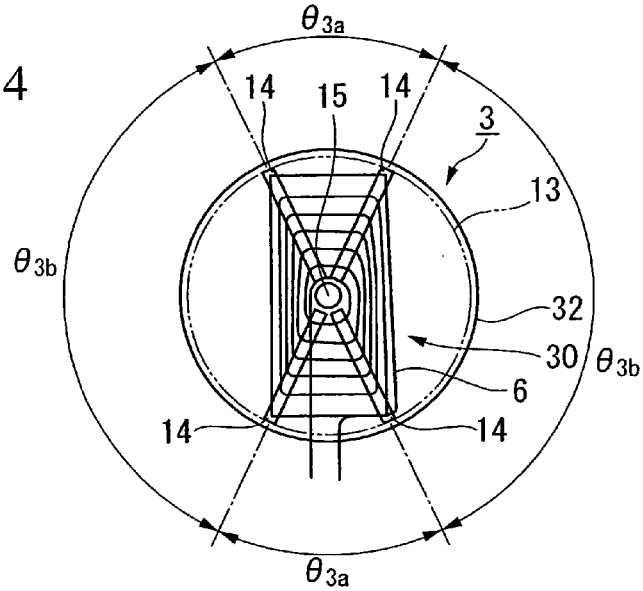
FIG. 4 is a plan view illustrating a winding jig and a polygonal coil according to a third embodiment of the present invention.

FIG. 4 is a plan view illustrating a winding jig and a polygonal coil according to a third embodiment of the present invention.

In a winding jig 3 according to this embodiment, four protrusions 14, 14, . . . are disposed on the surface of a first collar portion 32 opposed to the second collar portion 13 so as to protrude in a radial shape centered on an end of the core 15. The angles formed by the neighboring protrusions 14, 14, . . . are classified into two angles $\theta_{3A}$ and $\theta_{3B}$ and the protrusions 14, 14, . . . are arranged so that the neighboring angles are different from each other. The third embodiment is similar to the first embodiment, except for the arrangement pattern of the protrusions.

A polygonal coil 30 manufactured using the winding jig 3 as described above has a substantially rectangular shape.

Fourth Embodiment

Figure 5A:
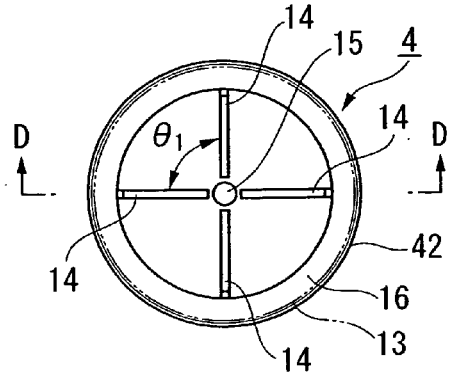
FIG. 5A is a plan view illustrating a winding jig according to a fourth embodiment of the present invention.
Figure 5B:
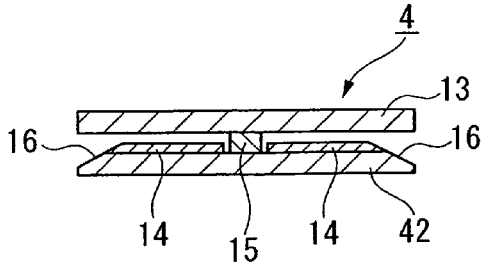
FIG. 5B is a cross-sectional view taken along line D-D of FIG. 5A.

FIGS. 5A and 5B are diagrams illustrating a winding jig according to a fourth embodiment of the present invention, where FIG. 5A is a plan view and FIG. 5B is a cross-sectional view taken along line D-D of FIG. 5A.

A winding jig 4 according to this embodiment is similar to the winding jig according to the first embodiment, except that a tapered surface 16 is formed on the surface of a first collar portion 42 opposed to the second collar portion 13 so as to extend to the ends of the protrusions 14. Since the tapered surface is formed in this way, the conductive wire 6 can be easily wound on the winding jig 4 at the time of manufacturing a coil. By using the winding jig 4 according to this embodiment, it is possible to manufacture a polygonal coil having the same substantial square shape as the first embodiment.

Even when the number of protrusions is not four, the same advantage is obtained, of course, by forming the tapered surface. Although it has been described in this embodiment that the tapered surface is formed in the outer peripheral edge of the first collar portion, the tapered surface may be formed in the outer peripheral edge of the surface of the second collar portion opposed to the first collar portion, or the tapered surface may be disposed on the outer peripheral edges of both the first and second collar portions.

Fifth Embodiment

Figure 6:
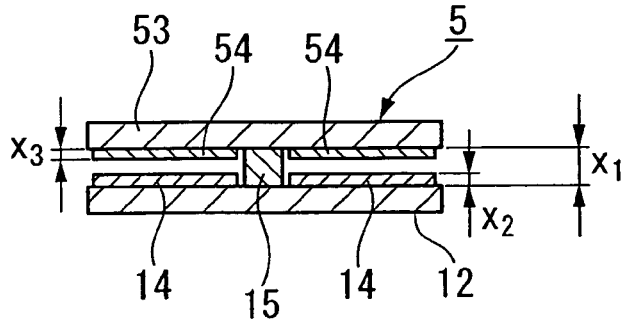
FIG. 6 is a schematic diagram illustrating a winding jig according to a fifth embodiment of the present invention.

FIG. 6 is a schematic diagram illustrating a winding jig according to a fifth embodiment of the present invention.

In a winding jig 5 according to this embodiment, four protrusions 54, 54, . . . having a height $X_3$ are formed on the surface of a second collar portion 53 opposed to the first collar portion 12 so as to protrude in a radial shape centered on an end of the core 15. The protrusions 54, 54, . . . are disposed at the positions corresponding to the protrusions 14, 14, . . . on the first collar portion 12 as viewed in the axis direction of the core 15. The protrusions 54, 54, . . . have the same material and shape as the protrusions 14, 14, . . . . Accordingly, the angles formed by the neighboring protrusions 54, 54, . . . are equal to the angles formed by the neighboring protrusions 14, 14, . . . . Except for this point, the fifth embodiment is equal to the first embodiment.

It is preferable that the distance $X_1$ is the same as the first embodiment and a distance ($X_1$-$X_2$-$X_3$) is in the range of 1.0 to 1.5 times the diameter of the conductive wire 6.

By using the winding jig 5 according to the fifth embodiment, it is possible to manufacture a polygonal coil having the same substantially square shape as described in the first embodiment.

Although the number of protrusions is four in this embodiment, the number of protrusions is not particularly limited but may be properly selected depending on purpose, even when the protrusions are disposed on both the first and second collar portions. The tapered surface may be formed on the first and/or second collar portion, similarly to the fourth embodiment.

Although four protrusions 14 and four protrusions 54 are disposed in the fifth embodiment, four protrusions in total may be disposed at positions not overlapping with each other as viewed in the axis direction of the core in both the first collar portion and the second collar portion in the first embodiment. Specifically, two protrusions may be disposed on each of the first and second collar portions, or one protrusion may be disposed in one collar portion and three protrusions may be disposed in the other collar portion.

Although it has been described that the protrusions are disposed on the collar portions so as to be symmetric about the core, the protrusions may be disposed to be asymmetric as needed. That is, the angles formed by the neighboring protrusions may be different from each other.

Although the method of manufacturing a one-line multi-layer winding polygonal coil has been described, the winding jig according to the present invention may be used for manufacturing a polygonal coil other than the one-line multi-layer winding polygonal coil.

Figure 7A:
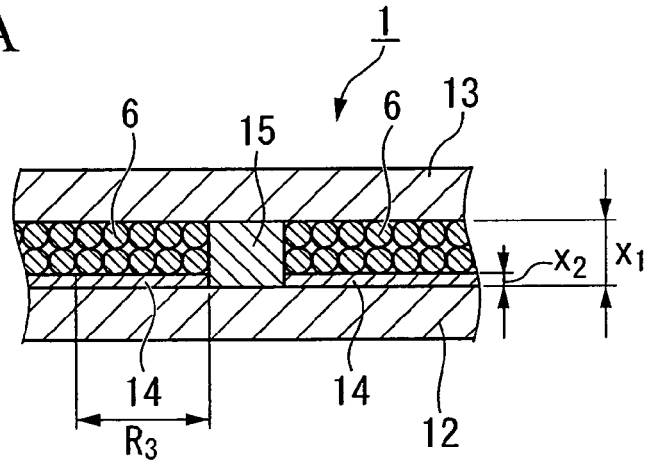
FIG. 7A is an enlarged cross-sectional view illustrating a region where protrusions are formed to explain a process of manufacturing a polygonal coil according to the present invention, where a conductive wire is wound on a winding jig.
Figure 7B:
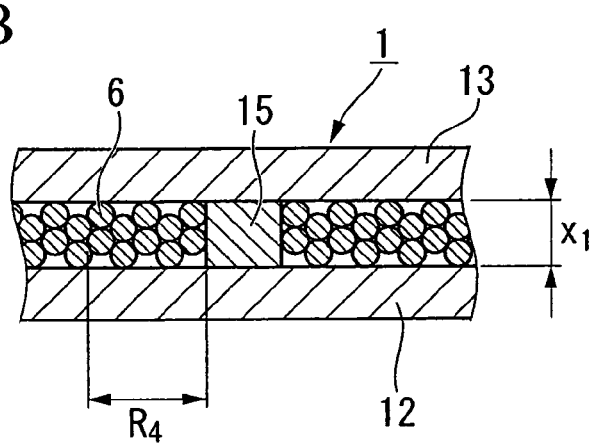
FIG. 7B is an enlarged cross-sectional view illustrating a region apart from the protrusions to explain a process of manufacturing a polygonal coil according to the present invention, where a conductive wire is wound on a winding jig.

For example, in the first embodiment shown in FIGS. 1A and 1B, by winding a conductive wire, which includes a plurality of thin metal wires tied in a bundle, in an overlapping manner in the diameter direction of a core by the use of a winding jig in which the distance $X_1$ is in the range of 2.5 to 2.9 times greater than the diameter of the conductive wire, the distance $(X_1-X_2)$ is in the range of 2.0 to 2.5 times greater than the diameter of the conductive wire, and the other configurations are equal to those of the first embodiment, it is possible to obtain a two-line multi-layer winding polygonal coil. FIGS. 7A and 7B are diagrams illustrating a process of manufacturing a polygonal coil using the winding jig and the conductive wire, where FIG. 7A is an enlarged cross-sectional view illustrating an area overlapping with the protrusions 14 in a state where the conductive wire 6 is wound on the winding jig 1 and FIG. 7B is an enlarged cross-sectional view illustrating an area apart from the protrusions 14. Here, since the distance $(X_1-X_2)$ is set to about twice the diameter of the conductive wire, the conductive wire 6 is wound in two lines at the positions overlapping with the protrusions 14. On the other hand, since the distance $X_1$ is set to about 2.5 times greater than the diameter of the conductive wire at the positions apart from the protrusions 14, the conductive wire 6 is wound as shown in FIG. 7B. Accordingly, in comparison with the diameters of the coil when the conductive wire 6 is wound the same number of times, the diameter $R_3$ at the positions overlapping with the protrusions 14 is larger than the diameter $R_4$ at the positions apart from the protrusions 14. As the number of times of winding the conductive wire 6 increases, the difference between $R_3$ and $R_4$ increases. Finally, the coil becomes a polygonal coil of which a part is wound in two lines and which has a substantial square shape having vertexes at four positions in the outer peripheral edge overlapping with the protrusions 14, 14, . . . . The resultant polygonal coil has a thickness smaller at the positions overlapping with the protrusions 14 than in the other positions.

Although this configuration has been described as a modified example of the first embodiment, it is possible to manufacture a multi-line multi-layer winding polygonal coil even when the same configuration is used in the second to fourth embodiments. In the fifth embodiment, even when the distance $X_1$ is set to 2.5 to 2.9 times greater than the diameter of the conductive wire and the distance $(X_1-X_2-X_3)$ is set to 2.0 to 2.5 times greater than the diameter of the conductive wire, it is possible to similarly manufacture a multi-line multi-layer winding polygonal coil.

Although it has been described that the conductive wire 6 including the plurality of thin metal wires tied in a bundle is used, a single metal wire may be used instead of the conductive wire 6 in any embodiment of the present invention. In this case, it is possible to manufacture a polygonal coil, as in the case where the conductive wire 6 is used.

Furthermore, although one single metal wire may be wound on the core, from the viewpoint of workability, it is preferable that a plurality of single metal wires are simultaneously wound on the core. In this case, the term "a plurality of single metal wires are simultaneously wound" means that a bundle of a plurality of single metal wires which are merely contacting each other without fixing their positional relationship (non-contact portions may be exist between the single metal wires) or a plurality of single metal wires which are supplied along different directions are simultaneously wound on the core, and the meaning of the term is different from a bundle of a plurality of single metal wires in which the positional relationship thereof is fixed or restricted so as to prohibit their relative movement are simultaneously wound on the core.

It is preferable that a diameter of the single metal wire is 30 to 800 μm.

In addition, it is preferable that the above-described distance $X_1$ of the winding jig according to the first embodiment is set to 1.5 to 1.9 times greater than the diameter of the single metal wire, and is preferable that the above-described distance $(X_1-X_2)$ of the winding jig according to the first embodiment is set to 1.0 to 1.5 times greater than the diameter of the single metal wire.

Figure 8A:
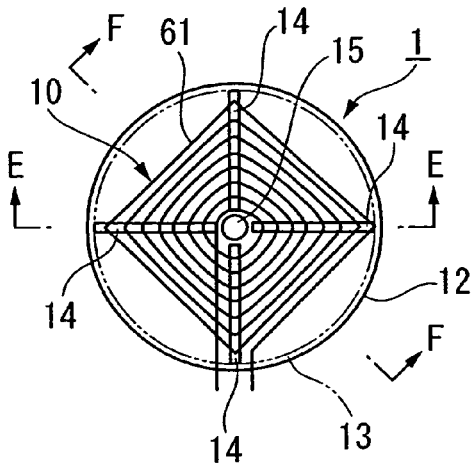
FIG. 8A is a plan view illustrating a process of manufacturing a polygonal coil according to the present invention, where a conductive wire is wound on the winding jig.
Figure 8B:
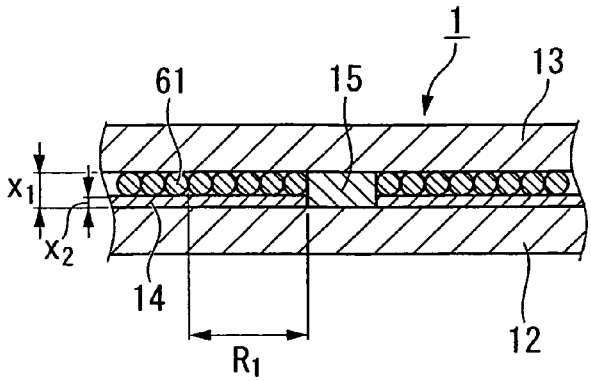
FIG. 8B is an enlarged cross-sectional view taken along line E-E of FIG. 8A.
Figure 8C:
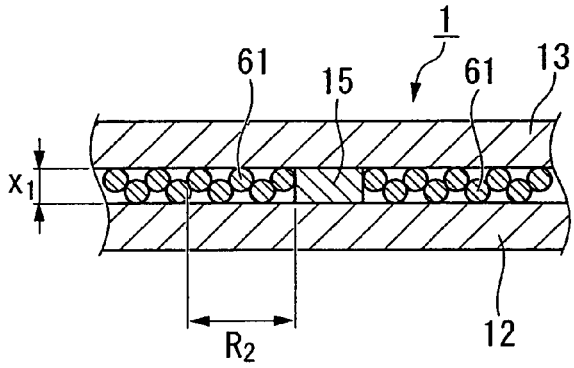
FIG. 8C is an enlarged cross-sectional view taken along line F-F of FIG. 8A.

FIGS. 8A to 8C show the state where the single metal wire 61 is wound on the winding jig.

Figure 9A:
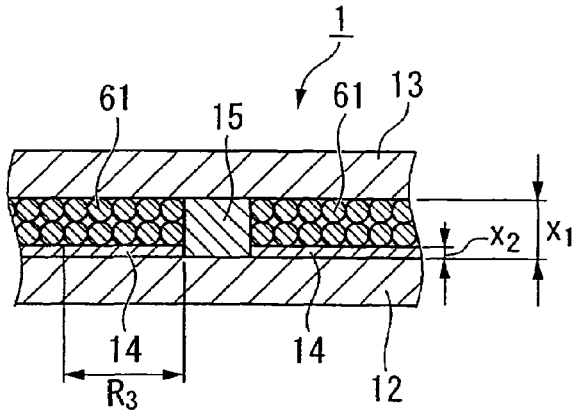
FIG. 9A is an enlarged cross-sectional view illustrating a region where protrusions are formed to explain a process of manufacturing a polygonal coil according to the present invention, where a conductive wire is wound on a winding jig.
Figure 9B:
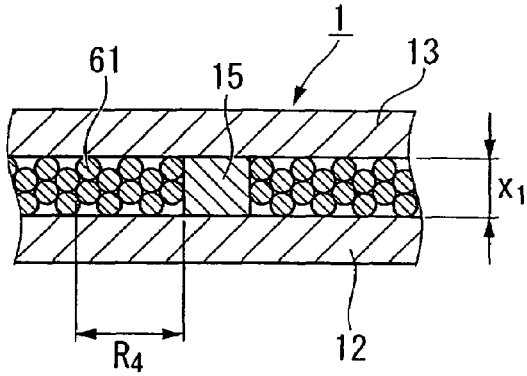
FIG. 9B is an enlarged cross-sectional view illustrating a region apart from the protrusions to explain a process of manufacturing a polygonal coil according to the present invention, where a conductive wire is wound on a winding jig.
Figure 10:
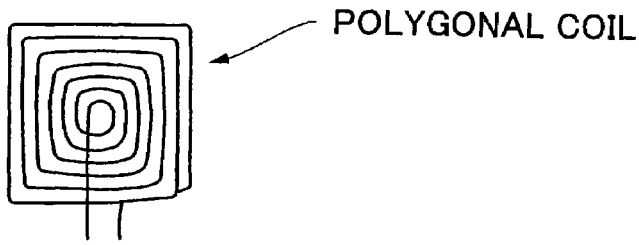
FIG. 10 is a diagram illustrating a polygonal coil.
Figure 11A:
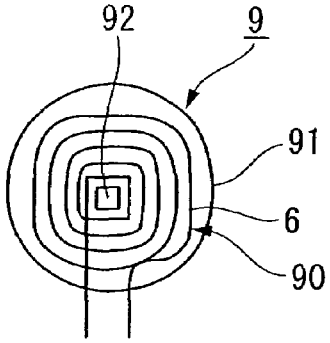
FIG. 11A is a diagram illustrating a conventional method of manufacturing a coil of which the core is polygonal.
Figure 11B:
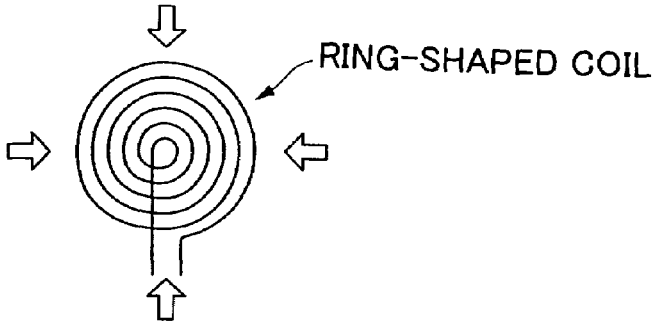
FIG. 11B is a diagram illustrating a conventional method of shaping a coil by the use of a press shaping method.
Figure 12:
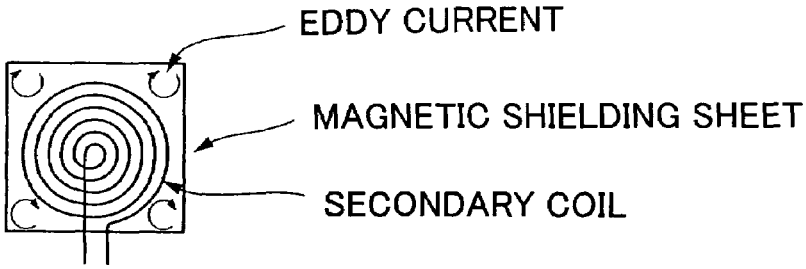
FIG. 12 is a diagram illustrating a state where eddy current occurs in a magnetic shielding sheet to which a ring-shaped secondary coil is attached.

Furthermore, FIGS. 9A and 9B show the state where the single metal wire 61 is wound on the winding jig in which the above-described distance $X_1$ of the winding jig according to the first embodiment is set to 2.5 to 2.9 times greater than the diameter of the single metal wire, and the above-described distance $(X_1-X_2)$ of the winding jig according to the first embodiment is set to 2.0 to 2.5 times greater than the diameter of the single metal wire.

Furthermore, the winding jig in which the distance $X_1$ of the winding jig according to the fifth embodiment is set to 2.5 to 2.9 times greater than the diameter of the single metal wire, and the distance $(X_1-X_2-X_3)$ of the winding jig according to the fifth embodiment is set to 2.0 to 2.5 times greater than the diameter of the single metal wire, can be used as the winding jig.

According to the present invention described above, it is possible to obtain a polygonal coil having a desired shape with high precision by only winding a conductive wire on a winding jig, without shaping a ring-shaped coil in a polygonal shape. The winding jig has a simple structure, and the coil manufacturing process is simple, and a polygonal coil with high quality can be manufactured at low cost.

Furthermore, in the present invention, it is preferable that the protrusions are provided on the winding jig at three or more positions which are different each other in a direction around an axis (peripheral direction) of the core.

While preferred embodiments of the present invention have been described and illustrated above, it should be understood that these are exemplary of the present invention and are not to be considered as limiting. Additions, omissions, substitutions, and other modifications can be made without departing from the spirit or scope of the present invention. Accordingly, the present invention is not to be considered as being limited by the foregoing description, and is only limited by the scope of the appended claims.

The invention claimed is:

1. A winding jig comprising a core on which a conductive wire or a single metal wire is wound and collar portions disposed at both ends of the core so as to be opposed to each other, wherein a plurality of rod-shaped protrusions is disposed on at least one of the opposed surfaces of the collar portions so as to protrude in a radial shape centered on an end of the core.

2. The winding jig according to claim 1, wherein the plurality of protrusions are disposed on only one of the opposed surfaces of the collar portions.

3. The winding jig according to claim 1, wherein the plurality of protrusions are disposed on both of the opposed surfaces of the collar portions.

4. The winding jig according to claim 1, wherein the number of protrusions is four.

5. A method of manufacturing a polygonal coil by winding one or a plurality of single metal wire(s) or a conductive wire in a diameter direction of the core on the core in an overlapping manner by the use of the winding jig according to claim 4.

6. A polygonal coil obtained by winding one or a plurality of single metal wire(s) or a conductive wire in a diameter direction of the core on the core in an overlapping manner by the use of the winding jig according to claim 4.

7. The polygonal coil according to claim 6, wherein the polygonal coil is a rectangular coil in which a conductive wire having one or a plurality of single metal wire(s) or a plurality of thin metal wires tied in a bundle is wound in the diameter direction of the core in a one-line overlapping manner.

8. A method of manufacturing a polygonal coil by winding one or a plurality of single metal wire(s) or a conductive wire in a diameter direction of the core on the core in an overlapping manner by the use of the winding jig according to claim 1.

9. A polygonal coil obtained by winding one or a plurality of single metal wire(s) or a conductive wire in a diameter direction of the core on the core in an overlapping manner by the use of the winding jig according to claim 1.

10. The polygonal coil according to claim 9, wherein the polygonal coil is a rectangular coil in which a conductive wire having one or a plurality of single metal wire(s) or a plurality of thin metal wires tied in a bundle is wound in the diameter direction of the core in a one-line overlapping manner.

* * * * *